United States Patent [19]

Ottieri

[11] Patent Number: 4,969,278

[45] Date of Patent: Nov. 13, 1990

[54] CLOSURE ACTUATED TIGHTENING MECHANISM FOR SKI BOOT HAVING VARIABLE VOLUME INNER SHELL

[76] Inventor: Marco T. Ottieri, 15 W. 53rd St., Apt. 15C, New York, N.Y. 10019

[21] Appl. No.: 314,189

[22] Filed: Feb. 22, 1989

Related U.S. Application Data

[63] Continuation-in-part of Ser. No. 274,919, Nov. 22, 1988.

[51] Int. Cl.[5] ..... A43B 5/04

[52] U.S. Cl. ..... 36/119; 36/117

[58] Field of Search ..... 36/117–121, 36/50, 88, 93; 128/80 R, 80 H

[56] References Cited

U.S. PATENT DOCUMENTS

| | | | |
|---|---|---|---|
| 4,565,017 | 1/1986 | Ottieri | 36/117 |
| 4,654,985 | 4/1987 | Chalmers | 36/117 X |
| 4,669,202 | 6/1987 | Ottieri | 36/120 |
| 4,691,454 | 9/1987 | Ottieri | 36/117 |
| 4,696,117 | 9/1987 | Ottieri | 36/117 |
| 4,706,393 | 11/1987 | Marxer | 36/117 |
| 4,788,782 | 12/1988 | Pozzeron et al. | 36/119 |
| 4,800,659 | 1/1989 | Marega | 36/119 |
| 4,823,485 | 4/1989 | Kemmer | 36/119 |
| 4,841,650 | 6/1989 | Dodge et al. | 36/119 |

FOREIGN PATENT DOCUMENTS

| | | | |
|---|---|---|---|
| 0249115 | 12/1987 | European Pat. Off. . | |
| 0252517 | 1/1988 | European Pat. Off. . | |
| 3736931 | 6/1988 | France | 36/117 |
| 668165 | 12/1988 | Switzerland | 36/117 |

*Primary Examiner*—Paul T. Sewell
*Assistant Examiner*—Andrew O. Meyers
*Attorney, Agent, or Firm*—Lahive & Cockfield

[57] ABSTRACT

A ski boot comprises a rigid outer shell and an inner shell which is relatively flexible. The inner shell features a relatively flexible saddle region which extends over the metatarsal and/or instep portions of a wearer's foot. Tensile elements, such as cables or straps, cooperate with the saddle to provide a variable supporting force to the wearer's foot. The tensile elements extend from the saddle, under the sole of the inner shell and terminate on the heel spoiler. This construction enables a foot supporting tensioning force to be applied to the tensile elements by pivoting the heel spoiler to the closed position. The tensile elements are slackened and the foot supporting force is released as a result of opening the heel spoiler.

In another embodiment the ski boot features a hinged inner sole. The inner sole is secured to the outer shell in the phalanx region of the sole, and also is hingedly connected to the heel spoiler in the heel region of the inner sole. A hinge, either mechanical or natural, is disposed adjacent to or in common with the fastening point. The hinge enables heel, arch and metatarsal regions to pivot relative to the phalanx region of the sole to improve the ease of foot entry and exit.

5 Claims, 14 Drawing Sheets

CLOSURE ACTUATED TIGHTENING MECHANISM FOR SKI BOOT HAVING VARIABLE VOLUME INNER SHELL

This is a continuation-in-part of U.S. patent application Ser. No. 274,919, filed on Nov. 22, 1988. The present invention relates to ski boots and more particularly to improvements in rear entry ski boots.

BACKGROUND OF THE INVENTION

Rear entry ski boots have in recent years become quite popular for recreational skiers because of the ease of foot entry and the comfort which they provide. However, rear entry boots are not favored by expert and competitive skiers because they tend to offer less ski control and responsiveness.

Rear entry boots may comprise a rigid, outer shell, a heel (or rear) spoiler which is hingedly connected to the outer shell, and calf and shin cuffs which engage the lower portion of the wearer's leg. These boots also feature inner boots or boot liners, often made from flexible foam materials and fabrics, within which the wearer's foot is held. One or more buckles may hold the spoiler and calf cuff to an upper portion of the shell to close the boot. Such boots may be opened, to insert or remove the foot, by releasing the buckles and allowing the top of the spoiler to pivot rearwardly. The shell of such boots may be referred to as having a "fixed volume" because the shell is rigid and does not compress to engage the foot. Foot restraint systems have been developed to hold the skier's foot within the boot to assist in providing ski control. Such foot restraint systems typically comprise cables or straps which are mounted interior of the outer shell and are positioned so as to act upon the boot liner to hold the foot in position. These straps are usually actuated by a buckle located on the outside of the boot. Although these foot restraint systems provide some ski control, aggressive skiing may loosen the foot restraint systems, or cause the foot to become momentarily displaced.

Many expert and competitive skiers favor front or top entry ski boots which feature a variable volume shell and approximately three or four buckles mounted on the front portion of the boot. While these boots provide excellent ski control, they tend to be uncomfortable because of their unselectively tight fit and compression of the ski boot shell about the foot.

There is thus a need for a ski boot which bridges the gap between typical rear entry ski boots and front entry ski boots by providing skier comfort as well as acceptable ski control. Accordingly, it is an object of the invention to provide a ski boot which features easy and convenient foot entry and exit. Another object of the invention is to provide a ski boot which features enhanced ski control without sacrificing comfort. A further object of the invention is to provide a rear entry ski boot having the features noted above. It is also an object of the invention to provide an easily actuated tightening mechanism for the inner shell of the boot. Other objects of the invention will be apparent to those of ordinary skill in the art upon reading this disclosure.

SUMMARY OF THE INVENTION

The present invention comprises a ski boot having a substantially rigid outer shell; an inner, selectively variable volume shell; a heel spoiler which is hingedly connected to the outer shell; and an inner boot liner which engages the wearer's foot and is disposed between the foot and the inner shell. The boot may also feature a calf cuff mounted above the heel spoiler and/or a shin cuff hingedly affixed to a front portion of the outer shell.

In one embodiment of the invention the inner shell is somewhat flexible and is disposed interior of the rigid outer shell. The inner shell has a sole portion with raised side walls and heel, arch, metatarsal and phalanx regions. The inner shell functions to assist in providing foot support and ski control as its phalanx region is affixed to the sole of the outer shell. Additional support is provided, when the boot is closed, due to a hinged connection between the heel region of the inner sole and the heel spoiler. The inner shell also features a saddle region which extends over portions of the instep region of the foot. The saddle region of the inner shell is somewhat flexible and tensioning elements, such as cables, may engage the saddle region to selectively tighten the inner shell in the saddle region. Alternatively, the tensioning elements may be linked to the heel spoiler so as to be tightened and loosened upon the closing and opening of the heel spoiler. Preferably, the saddle does not cover the entire top portion of a wearer's foot. Rather, voids are present in the shell over areas of the foot which are known to be particularly sensitive to pressure.

The inner shell also features an ankle support structure for engaging the ankle region or lower shin area of the wearer. The ankle support structure comprises a bracelet or band which engages a portion of the wearer's leg just above the malleolus. The ankle bracelet may be secured to the remainder of the inner shell by vertical extensions which are directed upwardly from either side of the heel region of the sole to integrally connect to the bracelet. The ankle support functions to maintain contact between the wearer's foot and the sole of the boot for added ski control. The ankle support structure may be constructed such that the vertical extensions originate from the heel region of the sole, and pass behind and around the malleolus to the bracelet which is disposed over a portion of the lower shin. Alternatively, the vertical extensions may originate from the heel region of the sole, and pass around the front of the malleolus to the bracelet. The ankle support structure of the inner shell cooperates with either the heel spoiler, which is hingedly connected to both the outer shell, and the inner shell, or with the shin cuff to provide support to the ankle region and lower shin region of the skier by helping to maintain the skier's foot in the proper position within the boot.

In another embodiment, the invention features a hinged inner sole which may or may not be used in conjunction with the flexible inner shell. The hinged sole is secured to the outer shell of the boot in the phalanx region of the sole. A sole hinge or creased sole portion is disposed approximately at the border of the metatarsal and phalanx regions of the sole to enable the heel, arch and metatarsal regions of the sole to pivot relative the phalanx region. The heel spoiler is pivotally attached to both the heel region of the sole and the outer shell of the boot to facilitate pivotal movement of the heel, arch and metatarsal portions about the sole hinge. Preferably, the hinge connecting the heel spoiler to the inner sole is disposed at a forward portion of the heel region, slightly below an imaginary line connecting the spoiler-outer shell hinge and the metatarsal hinge. Thus, opening the heel spoiler by moving it rearwardly causes it to pivot about the spoiler-outer shell hinge. As it pivots about this hinge, it simultaneously pivots about the spoiler-inner sole hinge and also elevates the heel, arch, and metatarsal regions of the sole, causing these regions to pivot about the sole hinge.

The sole of the inner shell may also feature a width-adjustable metatarsal region. In this embodiment a centrally located gap is disposed in the phalanx, metatarsal and arch regions of the sole. This gap extends parallel to the central axis of the sole. A fastening element such as a threaded screw may be tightened to decrease the width of the sole, and loosened to increase the width of the sole.

As noted above, the inner shell of the present invention is disposed interior of and adjacent to the outer shell. While the outer shell is of a fixed volume, the inner shell may be described as having a selectively variable volume. That is, tensile elements, such as cables, act upon the saddle region of the inner shell and the ankle support of the inner shell to anchor the foot in a desired position during skiing activities. The relative flexibility of the inner shell enables the volume within the shell to decrease upon actuation of the tensile elements and foot restraining devices and to firmly retain the foot in position. The relatively large surface area of the saddle region and the ankle support structure provides added foot support without detracting from wearer comfort.

DETAILED DESCRIPTION OF THE INVENTION

Figure 1:
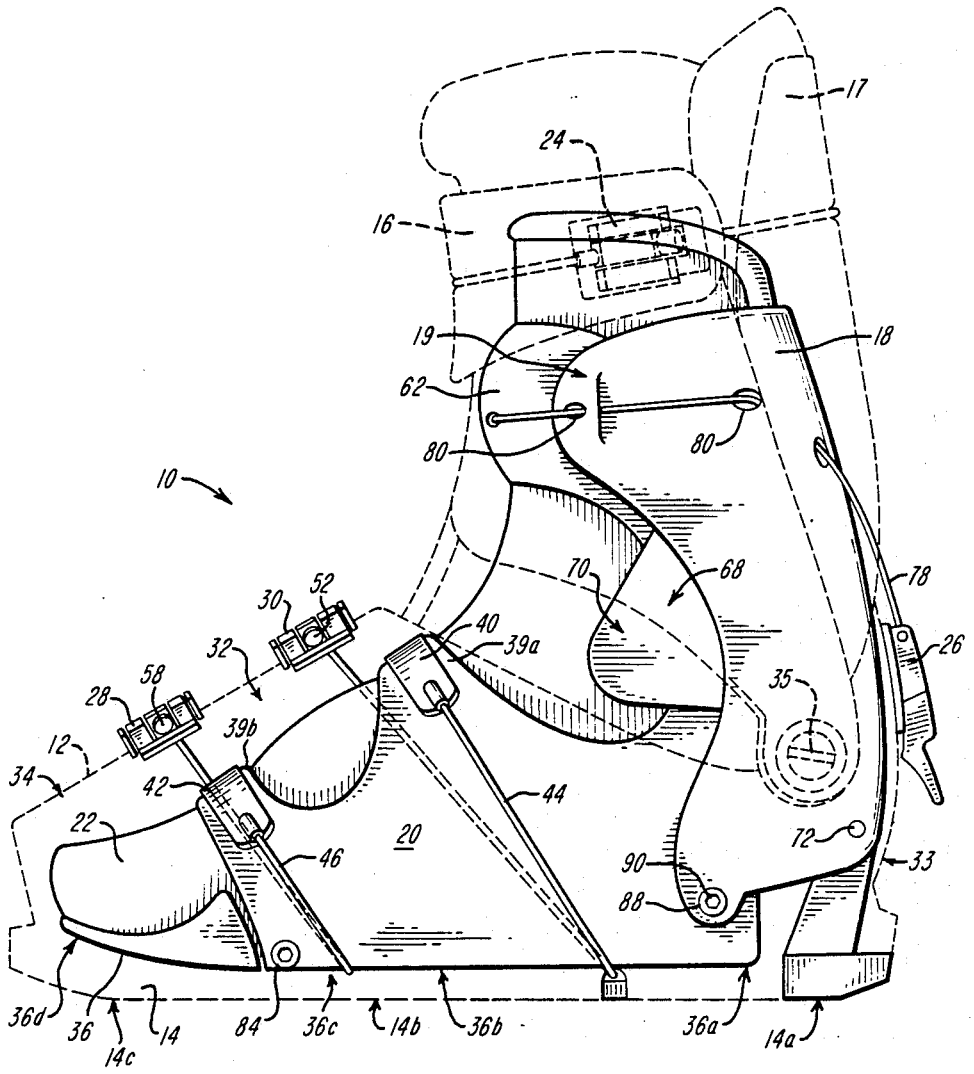
FIG. 1 is a side view of a ski boot according to the present invention, having an outer shell (shown in phantom), a flexible inner shell and a boot liner.
Figure 2:
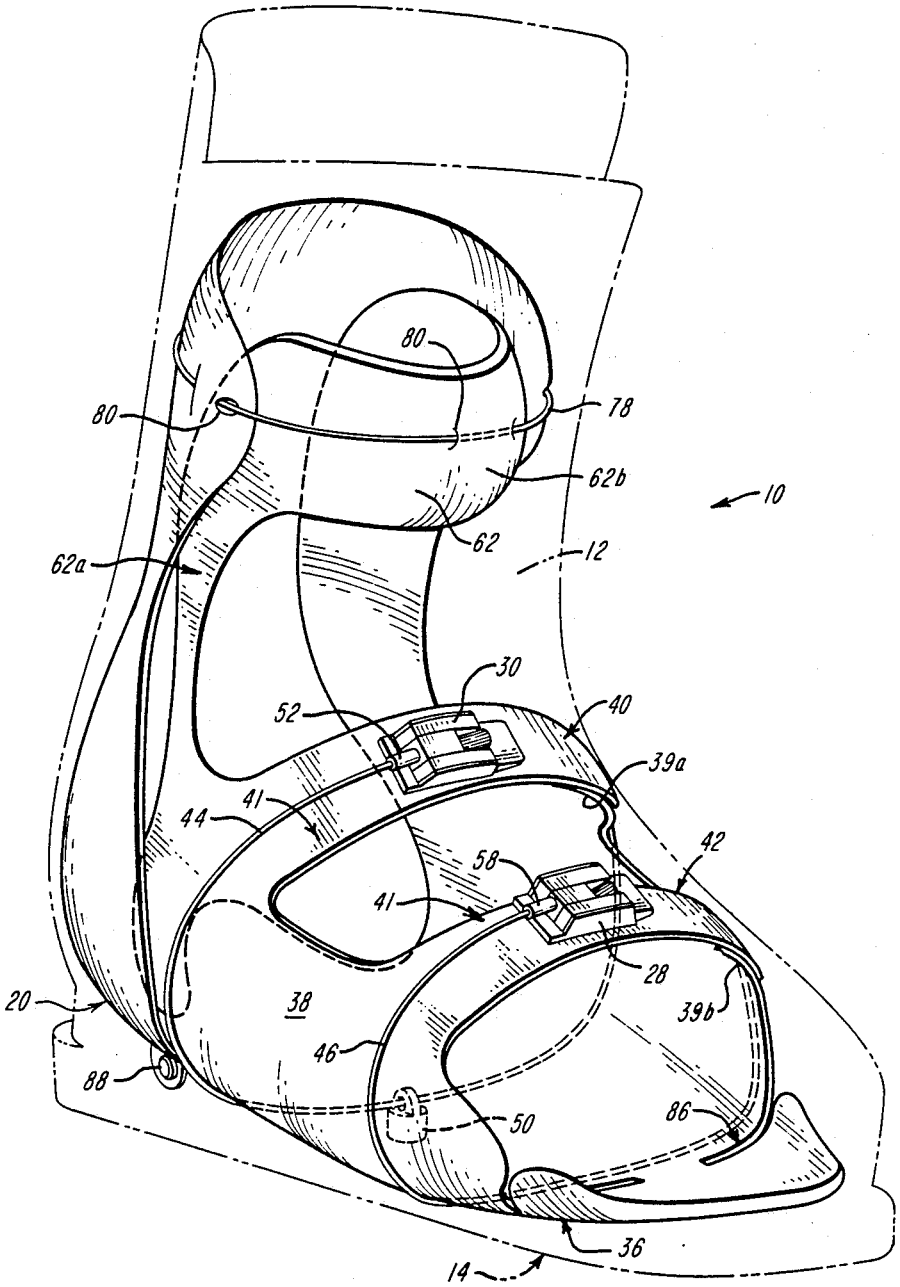
FIG. 2 is a front perspective view showing the inner shell of the present invention disposed within the outer shell.

A ski boot 10 according to the invention has, as shown in FIG. 1, an outer shell 12 having a sole portion 14; a shin cuff portion 16; a heel spoiler 18; and calf cuff 17. For ease of description sole portion 14 may be subdivided into heel **14*a*, arch 14*b* and metatarsal 14*c* regions. The illustrated boot also comprises an inner shell 20 disposed interior of an adjacent outer shell 12. A boot liner 22, designed to comfortably engage the skier's foot is removably and replaceably seated inside shell 20. Boot liner 22** may be made of a flexible, padded foam material and the construction of this item is well known in the art.

A shin cuff closure mechanism 24 may be utilized to hold the calf cuff 17 and shin cuff 16 together to close the boot. In addition, ankle bracelet tightening mechanism 26 may be rear mounted to partially close the boot by maintaining the heel spoiler 18 in a closed position relative to ankle support 62. Tightening mechanism 26 also assists in tightening the ankle support 62. Tension control mechanisms 28, 30 may be disposed on the top instep portion 32 of boot 10 to vary the volume within the inner shell and to provide selective control of a foot restraining system disclosed below.

Figure 11:
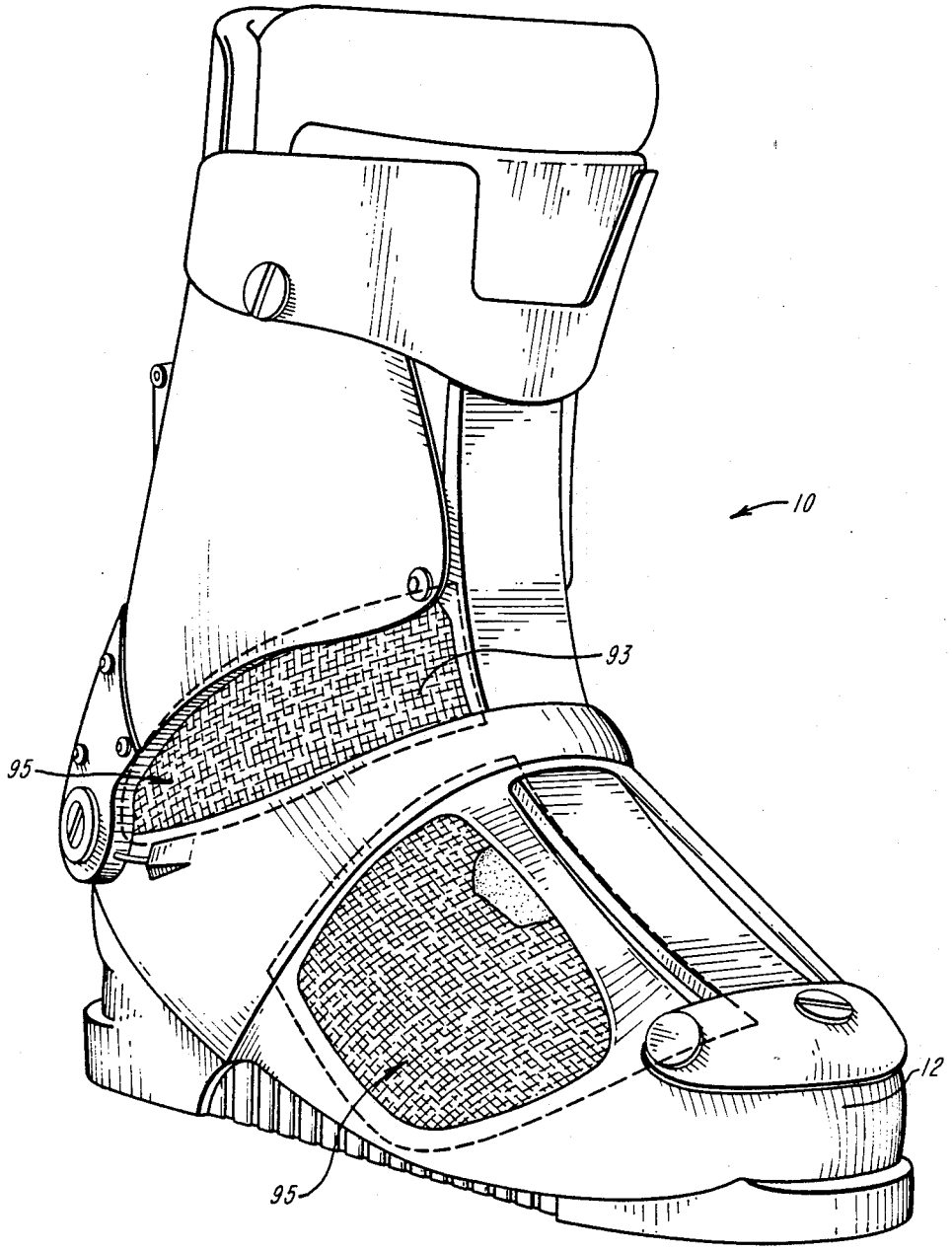
FIG. 11 is a perspective view of a ski boot made according to the present invention and having a non-continuously rigid outer shell.

Referring again to FIG. 1, the outer shell 12 is constructed of materials and in a manner well known in the art. For ease of description the outer shell 12 may be subdivided into a heel region 33, a toe region 34, and an instep region 32. Although the outer shell 12 is illustrated in FIG. 1 as having a continuously rigid surface over instep and toe regions 32, 34, it may also have a non-continuously rigid surface in which non-rigid areas 94 are disposed in and around the instep region 32 of the boot as shown in FIG. 11.

The shin cuff 16 and calf cuff 17, as illustrated in FIG. 1, are of the type conventionally used in ski boot constructions. The shin cuff 16 may be hingedly connected to the outer shell 12 by pin 35. Preferably, shin and calf cuffs 16, 17 cooperate, when closed by closure mechanism 24, to support the lower leg just above the skier's ankle and to provide forward and rearward lean control. It is understood that either the shin cuff 16 or calf cuff 17 may be omitted from a ski boot constructed according to the present invention, without a loss of ski control or foot support.

As illustrated in FIGS. 1 through 6, inner shell 20 is disposed interior of and adjacent to outer shell 12. Inner shell 20 comprises a sole portion 36 having heel **36*a*, arch 36*b*, metatarsal 36*c* and phalanx 36*d* regions. The sole portion 36 of inner shell 20 also has elevated side walls 38 which surround the sides of a skier's foot. Integrally appended to side walls 38, approximately overlying the instep of a wearer's foot, is saddle region 41. Saddle region 41 is more flexible than the side walls 38 and sole portion 36 of the inner shell. In this way the saddle 41 may be compressed about the wearer's foot to provide a selectively variable volume within the inner shell. Saddle 41 may overlap side walls 38** to a slight degree (e.g., 0.5–1.5 cm) in order to facilitate compression of the saddle portion of the inner shell. One or more tensile elements may extend around the inner shell and engage the saddle, cooperating with a tension control mechanism or other means to selectively vary the volume in this region of the inner shell.

In the embodiments illustrated in FIGS. 1 through 6, saddle 41 comprises saddle components 40 and 42.

Component 40 is, on one side of the inner shell, integral with side wall 38, and extends over the instep region of the wearer's foot. Component 40 overlaps with side wall extension 39*a* by approximately 0.5 to 1.5 cm. Saddle component 42 is similar in construction to component 40, but is disposed approximately over the metatarsal region of a wearer's foot.

The inner sole has been described as having a saddle component which may be in one or two pieces. Also, it is understood that one skilled in the art may easily devise alternative embodiments of the saddle feature of the present invention, while remaining within the scope of the present invention. Such alternative embodiments will provide a means of applying support to the wearer's foot by acting on instep and metatarsal regions of the foot, while avoiding the application of force to known pressure sensitive areas Of the foot. For example, one may utilize a strap extending over the instep portion of the wearer's foot and an additional strap extending over the metatarsal portion of the foot.

Tensile elements 44, 46 act in conjunction with saddle components 40, 42 to secure the skier's foot within the boot in order to provide ski control. Tensile element 44, best illustrated in FIGS. 1 and 2, comprises a cable, strap, like structure or combination thereof which extends over and in contact with saddle component 40. Tensile element 44 extends under a bottom portion of sole 36 and may extend through cable guide 50 which is anchored to the sole 14 of outer shell 12. One end 52 of tensile element 44 may extend to the exterior of outer shell 12 and may be secured within a tension control mechanism 30 disposed on the outer shell 12 in an area adjacent the instep of a wearer's foot. The opposite end of tensile element 44 may be secured to tension control mechanism 30 or to side wall extension 39*a*. Similarly, tensioning element 46 comprises a cable, strap, like structure or combination thereof which passes beneath inner shell sole 36. Tensile element 46 need not be anchored to outer shell sole 14. One end 58 of tensile element 46 is secured to a tension control mechanism 28 which is secured to the metatarsal region of outer shell 12. The opposite end of tensile element 46 may be secured to tension control mechanism 28 or to side wall extension 39*b*.

Figure 12:
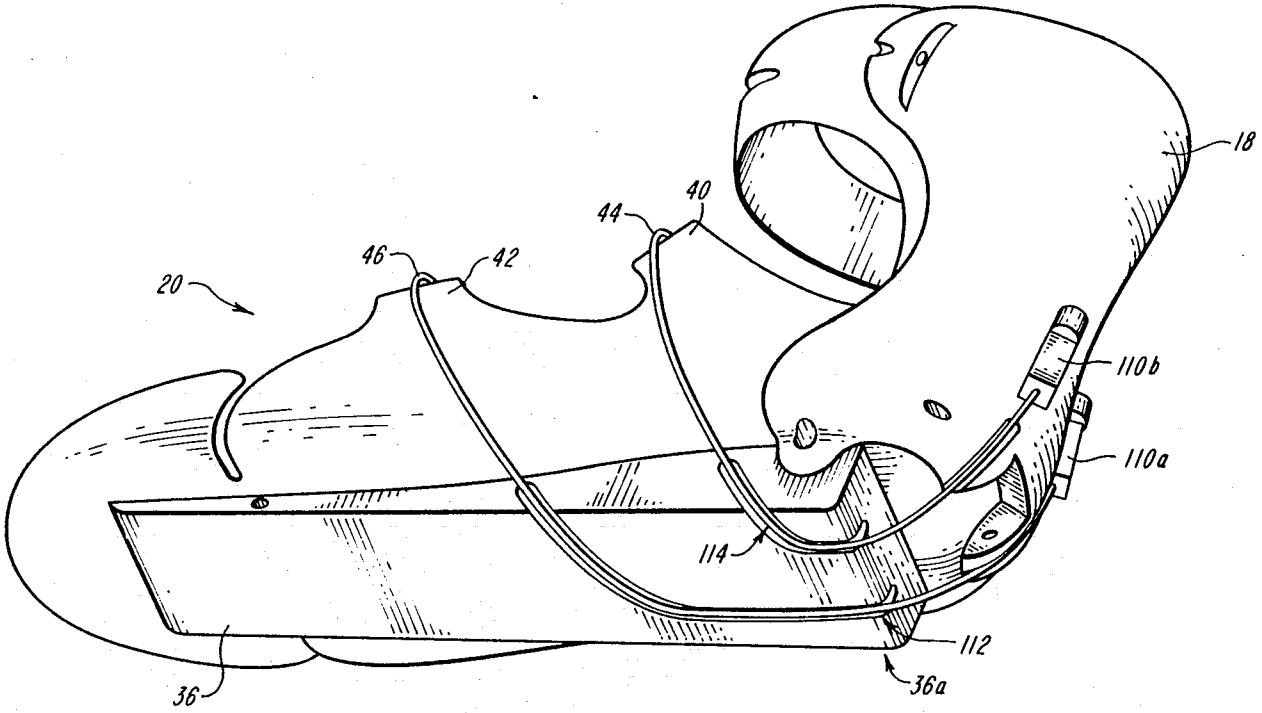
FIG. 12 is a bottom perspective view of a flexible inner shell of the present invention in which the saddle region of the inner shell may be tightened and loosened upon actuation of the heel spoiler.
Figure 13:
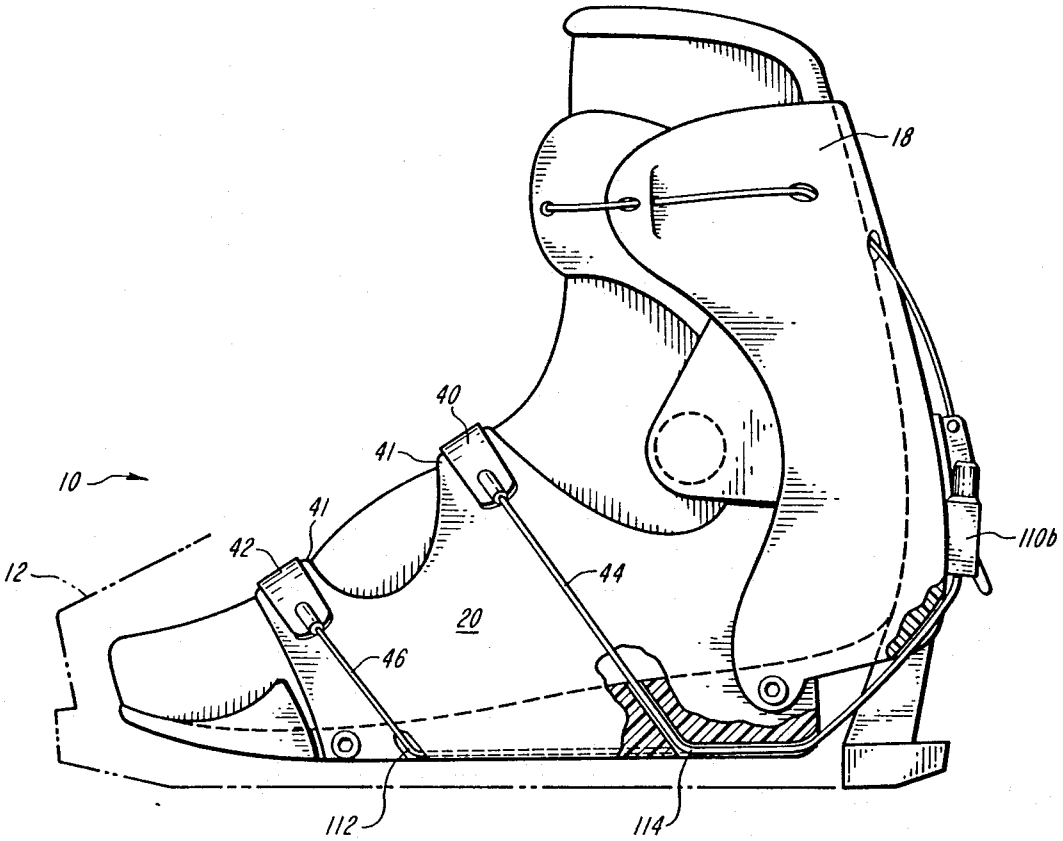
FIG. 13 is a side view, partially cutaway, of a closed ski boot having an inner shell of the type illustrated in FIG. 12.
Figure 14:
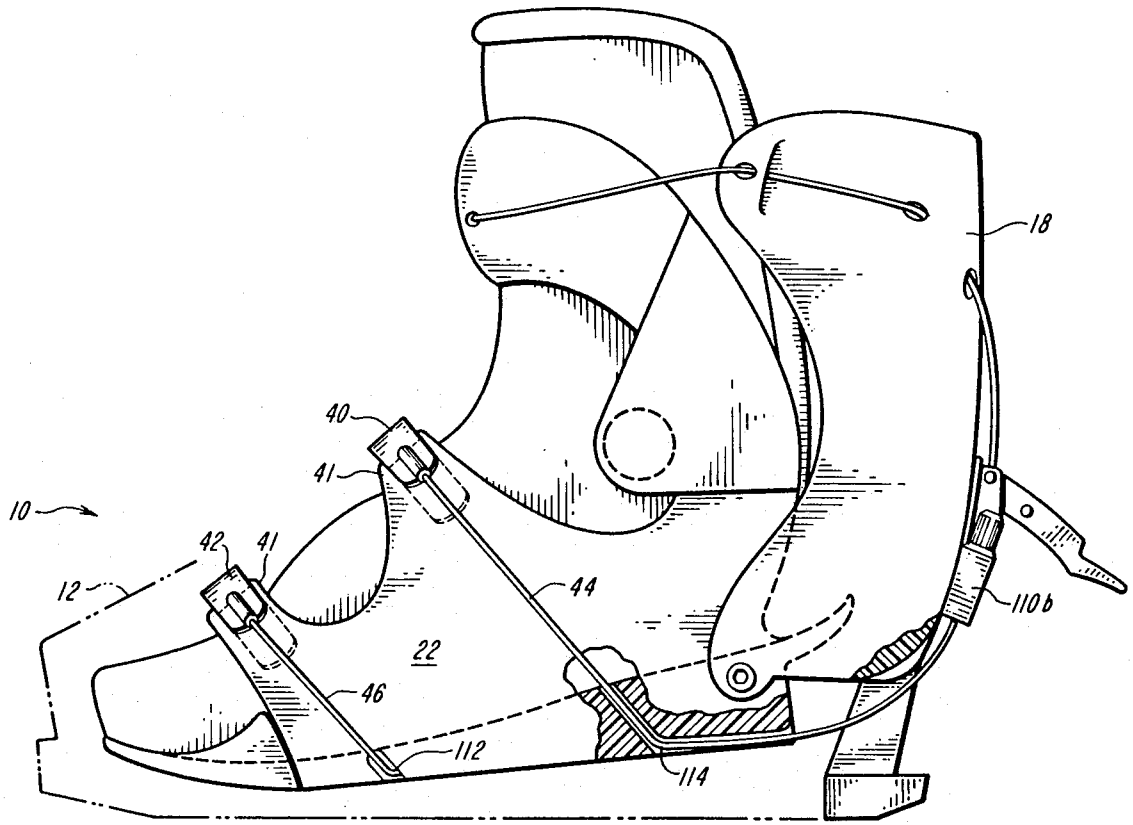
FIG. 14 is a side view, partially cutaway, of the ski boot of FIG. 13, in the open position.

In another embodiment, illustrated in FIGS. 12 through 14, tensile elements 44, 46 may secure the skier's foot within the boot without the need for a buckle mechanism. Instead of a buckle-type closure mechanism, tensile elements 44, 46 may be actuated by simply opening and closing the heel spoiler. Tensile elements 44, 46 extend from the saddle components 40, 42 and pass under, and/or around, the sole 36 of the inner shell 20. Tensile elements 44, 46 extend from beneath sole 36, around the heel portion 36*a*, to terminate in a tension adjusting mechanism 110 mounted on a rear portion of the heel spoiler 18. Preferably, tensile element 46 extends from saddle component 42 around the side of the boot and through channel 112 which directs cable 46 under, and/or around, sole 36. As best shown in FIG. 12, channel 112 is curved within sole 36 so as to direct cable 46 around the heel portion of the sole 36*a*. After exiting channel 112, cable 46 extends upwardly around to the rear portion of the heel spoiler 18. Cable 46 is threadedly secured to a tension adjusting mechanism 110*a* which is mounted to the rear of heel spoiler 18. Similarly, cable 44 extends from saddle component 40, around the side of the boot and through channel 114 and around heel portion 36*a*. Cable 44 then extends upwardly to the heel spoiler 18 and becomes threadedly secured to tension adjusting mechanism 110*b*.

Tension adjusting mechanism 110*a, b* are secured to the heel spoiler 18. Due to the threaded connection of tensile elements 44, 46 the overall length of those cables may be lengthened or shortened to control their tension. The tension may be adjusted so that when the boot is in the closed position (as shown in FIG. 13), tensile elements 44, 46 compress the saddle 41 of inner shell 20 to an extent sufficient to provide the required foot support. Conversely, when heel spoiler 18 is in the open position (as shown in FIG. 14), the tensile elements 44, 46 are slackened and tension is released to an extent sufficient to allow foot entry and exit.

A boot constructed according to this embodiment of the invention may be utilized as follows.

With the boot in the open position, as shown in FIG. 14, a skier may insert his foot within the boot. Upon closing heel spoiler 18, tension is applied to tensile elements 44, 46, causing them to compress the saddle 41 to impact support to the wearer's foot. Preferably, the length of the tensile elements 44, 46 above the sole of the boot is increased by approximately 1.0 to 1.5 cm upon loosening heel spoiler 18. When the boot is closed the length of the tensile elements above the sole is decreased by a similar amount. Tension adjusting mechanisms 110 allow for approximately 3.0 to 3.5 cm of adjustment to the length of tensile elements 44, 46 in order to accommodate wearers having various foot sizes and shapes.

As further illustrated in FIGS. 1–6, inner shell 20 also comprises an ankle support structure 62 which may be integral with and extend upwardly from side walls 38. In a preferred embodiment the ankle support structure 62 originates on either side of the heel region 36*a* of sole 36. Vertical members 62*a* extend upwardly from side walls 38 and may pass behind the malleolus of the wearer's foot. Alternatively, vertical members 62*a* may instead pass in front of the malleolus. The vertical members 62*a* then continue around the lower leg of the wearer to a bracelet or band portion 62*b* which supports the lower shin of the wearer.

Figure 3:
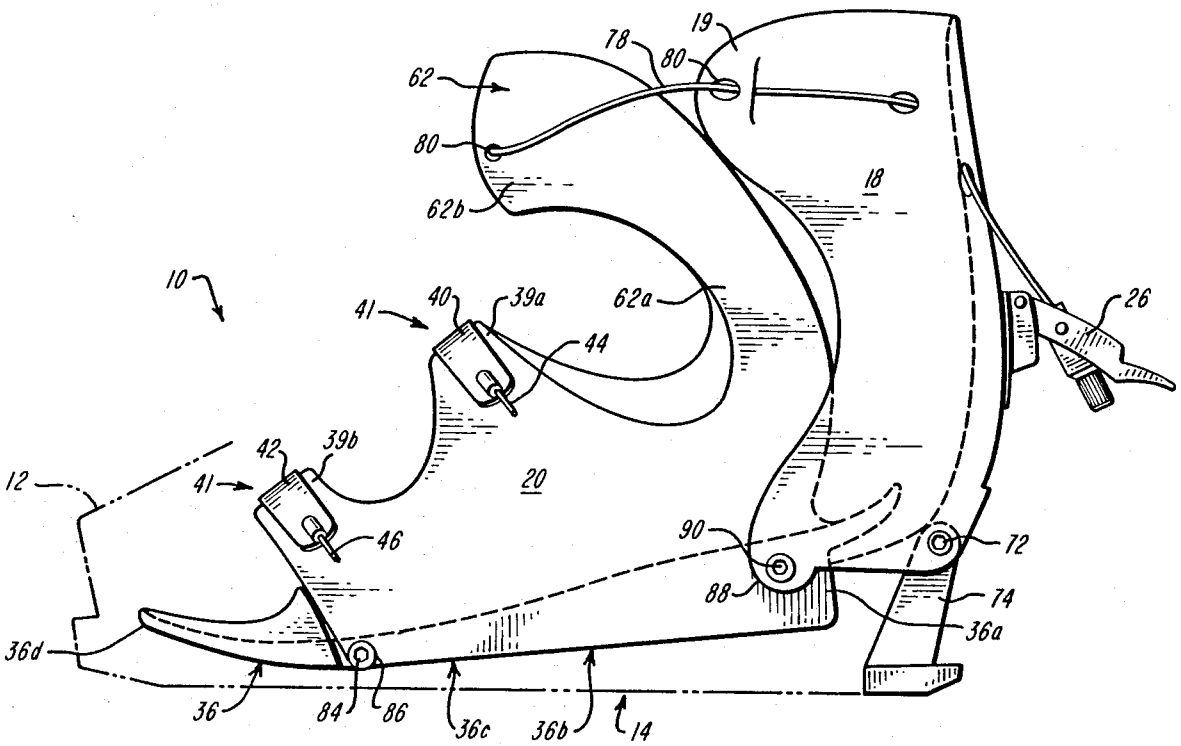
FIG. 3 is a side view, partially cut away, of a ski boot showing the flexible inner shell of the present invention in the open position.
Figure 4:
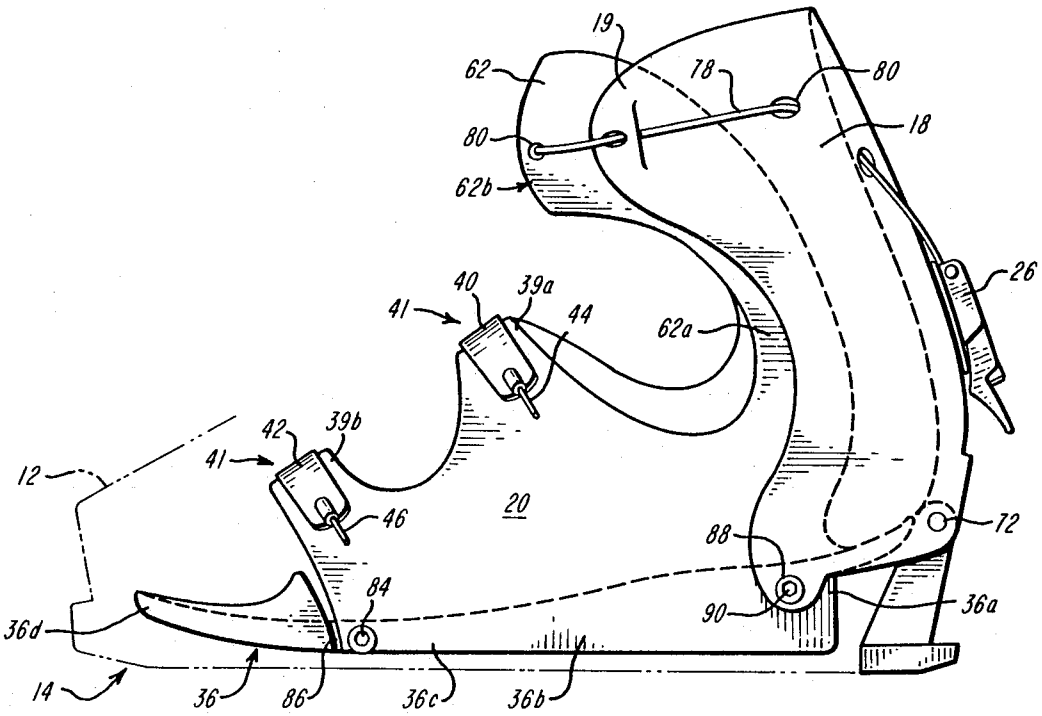
FIG. 4 is a side view of the boot of FIG. 3 in the closed position.
Figure 5:
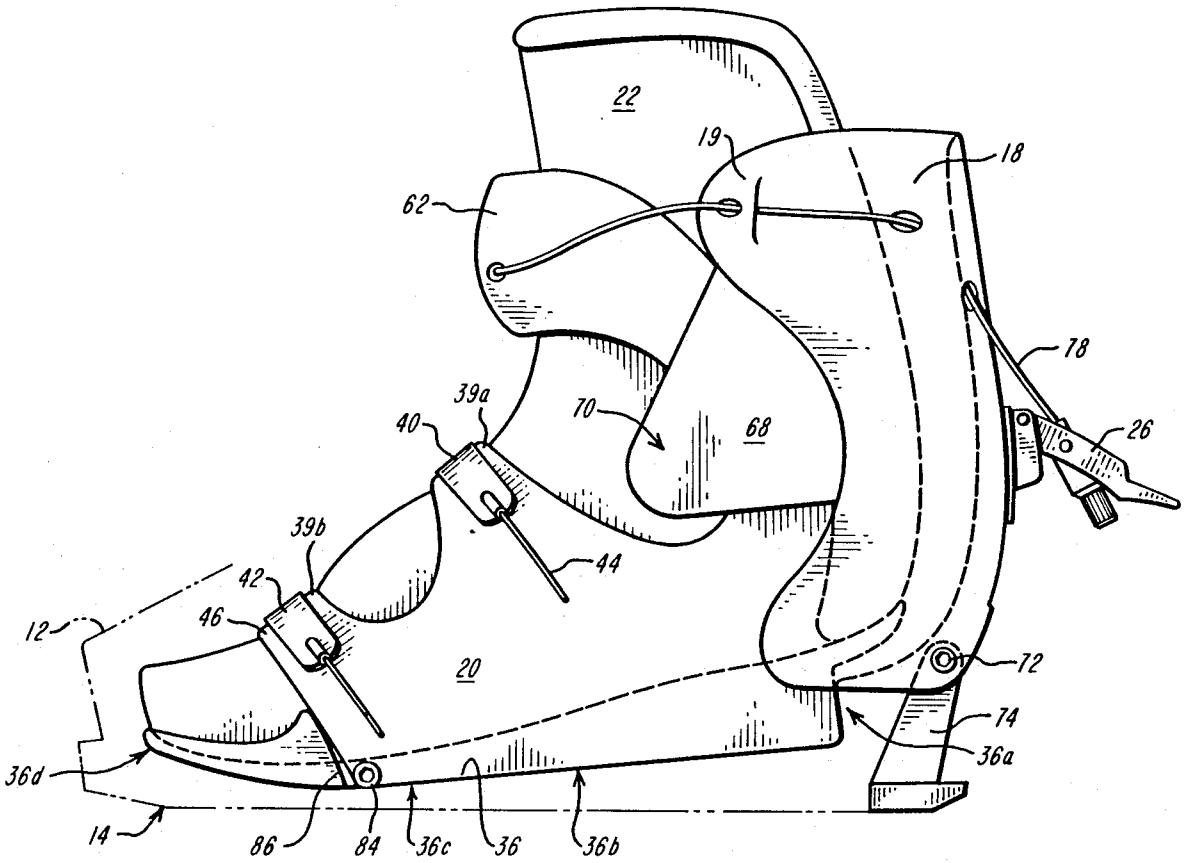
FIG. 5 is a side view of the boot shown in FIG. 3, having a boot liner disposed within the inner shell.

Ankle support structure cooperates with heel spoiler 18 to assist in providing foot support and excellent ski control by ensuring that the wearer's heel remains in contact with the sole of the ski boot. In FIGS. 3 and 5 heel spoiler 18 is in the open position to allow foot entry to the boot. When the heel spoiler 18 is closed, as in FIGS. 4 and 6, an outer portion 19 of heel spoiler 18 may surround and frictionally engage vertical members 62*a* of the ankle support. The heel spoiler 18 will remain secured in the closed position when buckle mechanism 26 is locked. With the heel spoiler 18 in the closed position, ankle support structure 62 and heel spoiler 18 cooperate to grasp the wearer's leg, slightly above the wearer's malleolus, to maintain the wearer's foot in contact with the boot. That is, the ankle support assists in providing foot support and ski control by maintaining the back of the wearer's leg in contact with the heel spoiler and ensuring that the wearer's heel is maintained in contact with the sole of the boot.

While the ankle support structure described above is currently preferred for providing such support, it is likely that the same effect may be obtained through the use of similar structures not described herein, but readily understood by those of ordinary skill in the art.

As noted above, boot liner 22 fits within inner shell 20 to provide comfort and insulation to the wearer. Preferably, boot liner 22 has centrally located open back portion (not shown) adjacent each side 66*a*, 66*b*. Disposed on either side of the opening may be a forwardly extending flap 68 which may be secured to the side of boot liner 22. Flaps 68 may be opened to encompass vertical member 62*a* of ankle support 62. The forward end 70 (FIGS. 1, 6) of flap 68 may be reattached to the boot liner by a fastening means, such as a VELCRO system, a snap or button. Such an engagement assures that the boot liner 22 will remain in the desired position.

Figure 6:
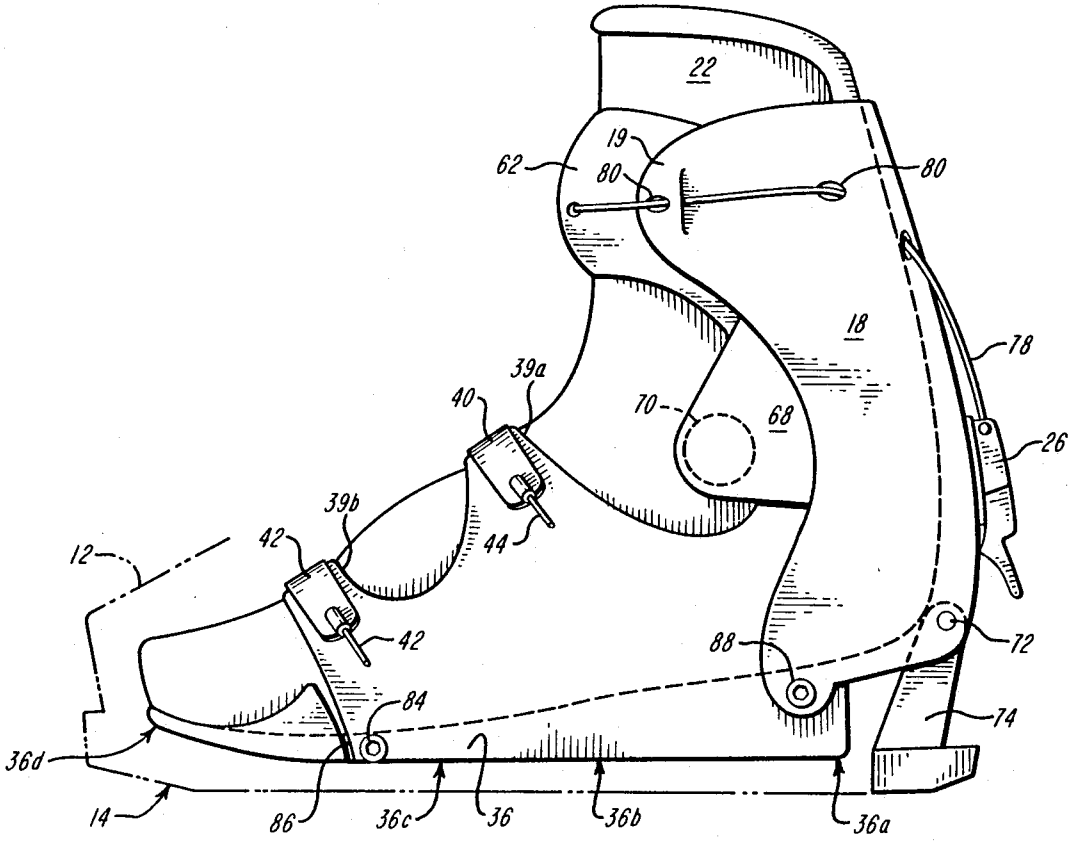
FIG. 6 is a side view of the boot of FIG. 4, having a boot liner disposed within the inner shell.

As best shown in FIGS. 1 and 3 heel spoiler 18 forms an exterior portion of the boot and is pivotably attached to the outer shell 12 of the boot. Preferably, spoiler 18 is attached to an upwardly extending flange 74 in the heel region of the outer shell 12. A heel spoiler hinge 72 or similar element which facilitates pivotal movement of spoiler 18 may secure the spoiler to flange 74. The heel spoiler hinge 72 enables heel spoiler 18 to flip rearwardly to open the rear portion of the boot 10. Cable 78 extends forwardly from the buckle 26 around either side of the heel spoiler and to the front portion 62*b* of ankle support 62. Guide channels 80 may be provided in the heel spoiler 18 and ankle support 62 to ensure positional stability of cable 78. A buckle mechanism 26 may be secured to the heel spoiler 18 to control the tension of cable 78. When buckle mechanism 26 is opened as shown in FIGS. 3 and 5, the cable 78 is slackened thereby allowing the heel spoiler 18 to pivot open to an extent sufficient to allow for insertion of the wearer's foot. When buckle 26 is closed, as shown in FIGS. 4 and 6, cable 78 is tightened, causing the heel spoiler 18 to engage ankle support 62 to support the wearer's leg.

One of ordinary skill in the art may easily construct an inner shell for use with the present invention. The inner shell should, of course, be able to fit within the outer shell, and should snugly envelop the boot liner. The thickness of the inner shell varies between 2 mm and 6 mm. Typically, the saddle region and the ankle support will be of a lesser thickness than other regions of the inner shell. The inner shell may be constructed of polymeric materials identical or similar to those usually used in the construction of the outer shells of ski boots.

In the embodiment of the invention illustrated in FIGS. 1–9, the sole 36 of the inner shell 20 is hinged such that the heel and metatarsal regions 36*a* and 36*b* may be elevated to facilitate removal of the foot. In this embodiment inner sole 36 is secured to the sole 14 of the outer shell by phalanx fastening mechanism 84 to provide added ski control. That is, fastening mechanism 84 enables a skier's foot to be held firmly to the outer shell of the boot, through the inner shell, so that foot movements may be translated directly to the ski. Fastening mechanism 84 may comprise virtually any device for joining inner shell 20 to outer shell 12. Currently, preferred devices include the pin, or screw mechanism shown in FIGS. 1–9, or the rail system as illustrated in FIGS. 10A and 10B.

Figure 10A:
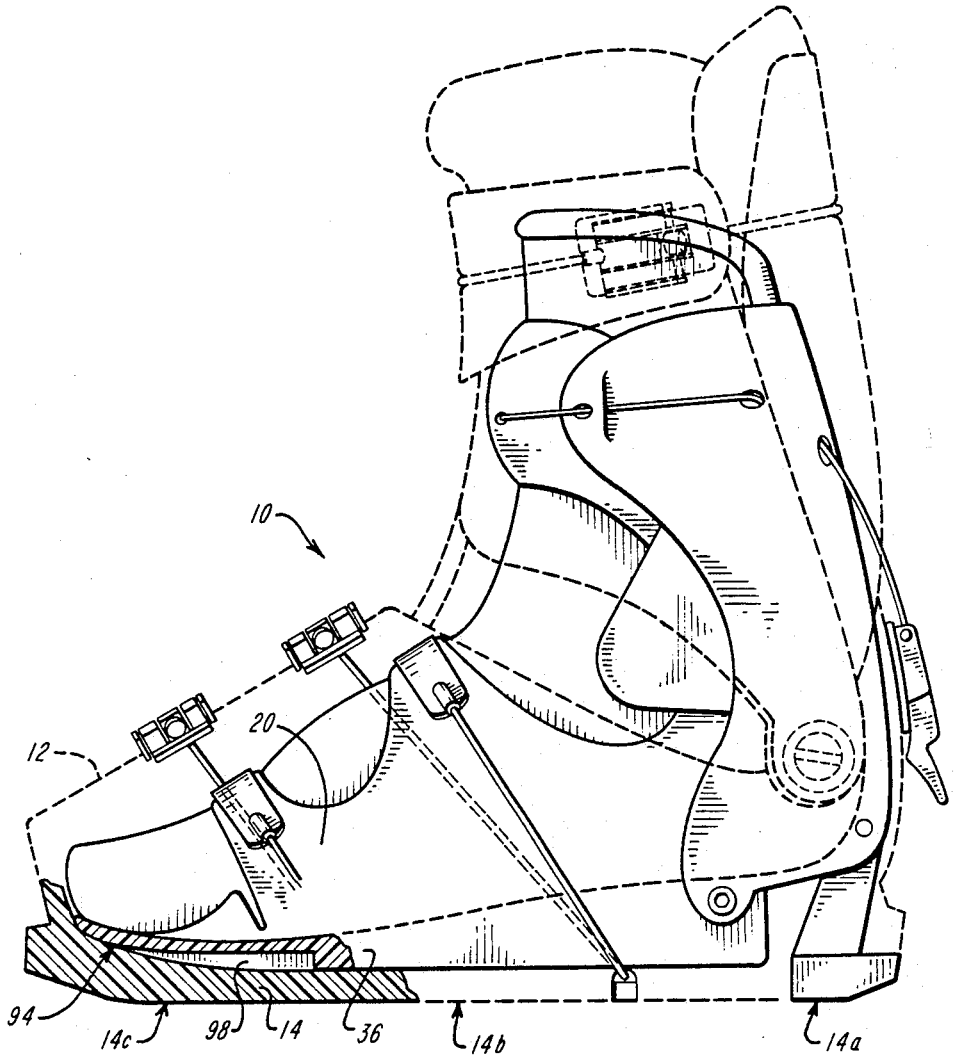
FIG. 10A is a side view showing an alternative embodiment of the inner shell and hinged sole of the present invention, in which the inner shell is secured to the outer shell by an interlocking rail system.
Figure 10B:
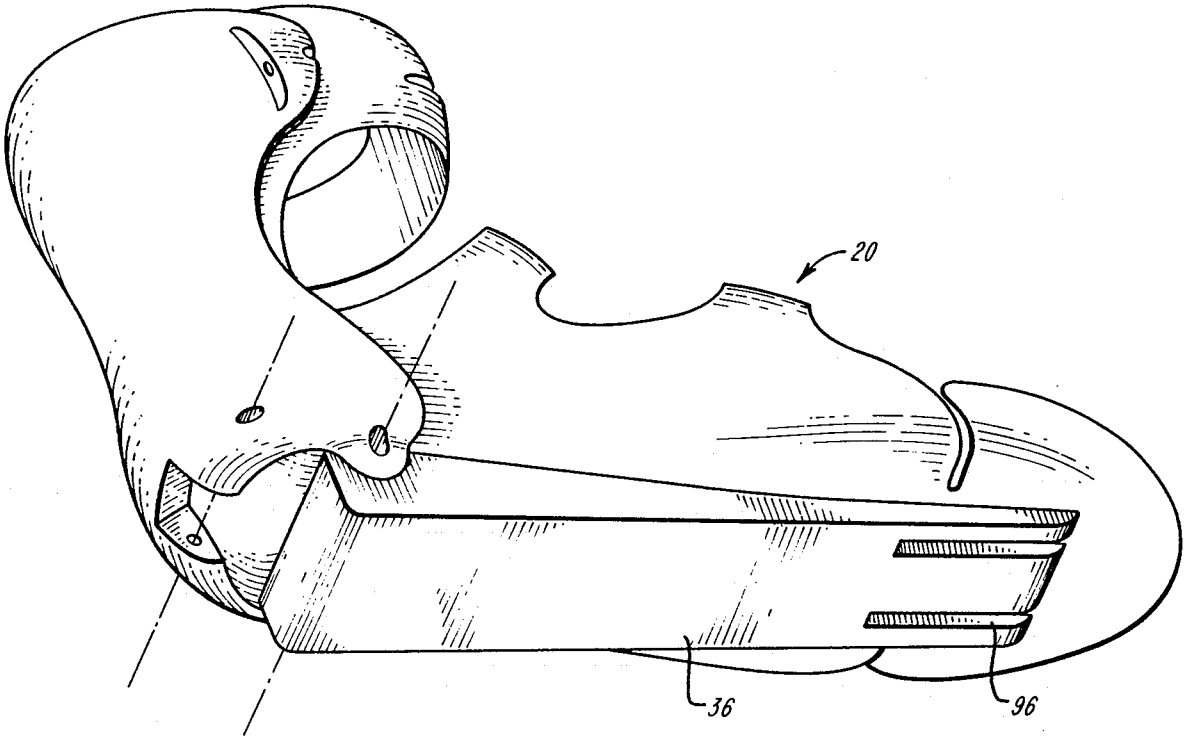
FIG. 10B is a perspective view of the inner shell of FIG. 10A, having a rail locking system.

FIGS. 10A and 10B illustrate an alternative embodiment of the invention in which inner shell 20 is secured to the outer shell 12 by an interlocking rail system 94.

In FIGS. 10A and 10B inner shell 20 features rails 96 (male or female) which seat within corresponding rails 98 mounted within the phalanx region of the outer shell 12. When the boot is closed the rails prevent independent movement of the inner shell. However, when the boot is open the sole, as well as the entire inner shell, is elevated to make entry to and exit from the boot more convenient, and the inner shell 20 may then slide backwards on the rails. When closing the boot, the weight of the wearer is exerted on the heel region, thus causing the sole to become horizontally oriented and at the same time effecting a catapult action to close the heel spoiler.

Referring to FIG. 11, the ski boot 10 may feature a non-continuously rigid outer shell 12. In this embodiment part of the surface of the outer shell 12 may have areas 93 which are not comprised of a rigid material. Instead, in these areas the outer shell may comprise a flexible water proof fabric 95, preferably a breathable material such as GORETEX. The non-rigid areas 93 of the boot illustrated in FIG. 11 may be disposed over the instep region of the boot and over other areas of the boot where rigidity is not required.

Sole 36 features a metatarsal hinge 82 adjacent fastening mechanism 84, and preferably disposed at the border of the phalanx and metatarsal regions. In a preferred embodiment the phalanx region of the sole 36*d* is integral with the rest of the sole. Metatarsal hinge 82 comprises a notched or creased portion 86 of sole 36 which acts as a natural hinge. In an alternative embodiment, not shown, the phalanx region 36*d* may be separate from heel, arch and metatarsal regions 36*a*, 36*b*, and 36*c* and may be joined by a fastening device, such as a screw or pin, which also serves as a mechanical hinge about which pivotal action may occur.

A forward heel hinge 88 is preferably used to pivotally join a forward extending, lower portion of heel spoiler 18 to inner sole 36. Forward heel hinge 88 comprises a fastening element such as a screw, pin or dowell 90 which extends through sole 36 further contributing to secure the inner shell to the outer shell. As illustrated in FIGS. 1, 4, 6, 8 and 9, when the heel spoiler 18 is in the closed position, the forward heel hinge 88 may be disposed forward of heel spoiler hinge 72 and below an imaginary line connecting metatarsal hinge 82 and heel spoiler hinge 72.

With forward heel hinge 88 positioned below heel spoiler hinge 72, a lifting force is exerted on heel region 36*a* of sole 36 when heel spoiler 18 is pivoted rearwardly to open the boot. The lifting action imparted by opening heel spoiler 18 is best illustrated in FIGS. 3 and 5. When the heel spoiler 18 is pivoted rearwardly, heel, arch and metatarsal regions 36*a*, 36*b*, 36*c* are elevated and pivot about metatarsal hinge 82. Despite the elevation of heel, arch and metatarsal regions, the phalanx region 36*d* remains fixed to the outer shell 12 of boot 10.

The hinged sole embodiment of the present invention is considered to be advantageous as opening the boot causes the wearer's foot to be raised and angled in a direction which facilitates its removal from the boot. Similarly, it is easier for a wearer to insert a foot into the boot as the elevated heel, arch and metatarsal regions 36*a*, 36*b*, 36*c* provide a type of ramp to assist the foot in becoming properly seated in the boot.

Figure 7:
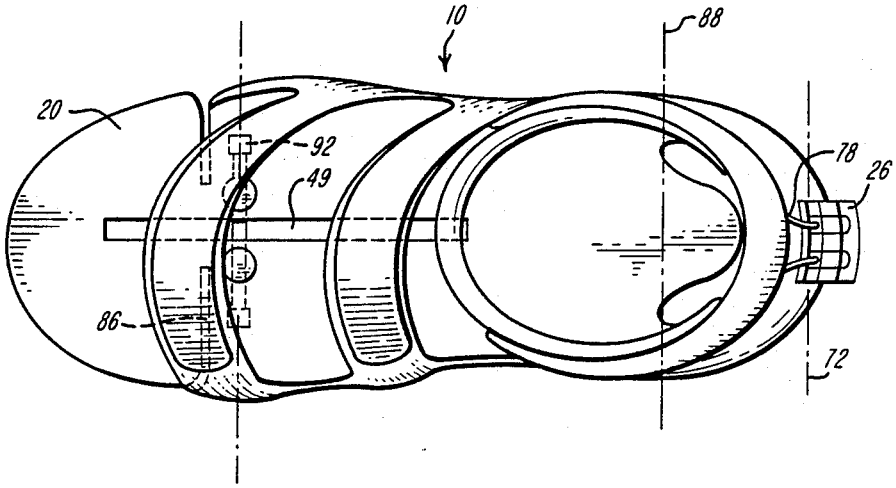
FIG. 7 is a top view of the flexible inner shell of the present invention, having a hinged, width adjustable sole.
Figure 8:
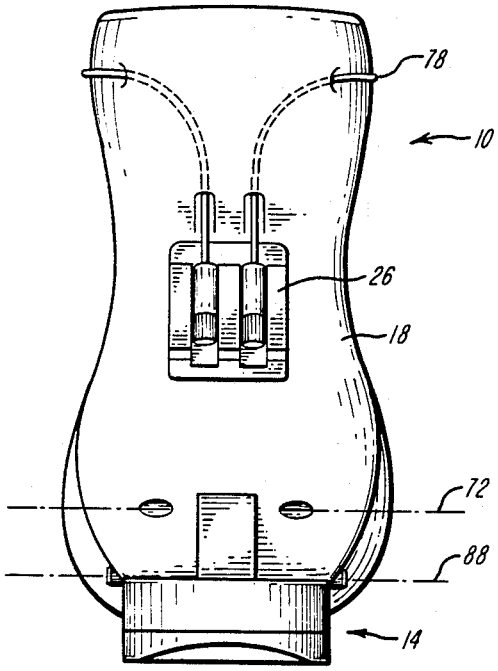
FIG. 8 is a rear view of the shell shown in FIG. 7.
Figure 9:
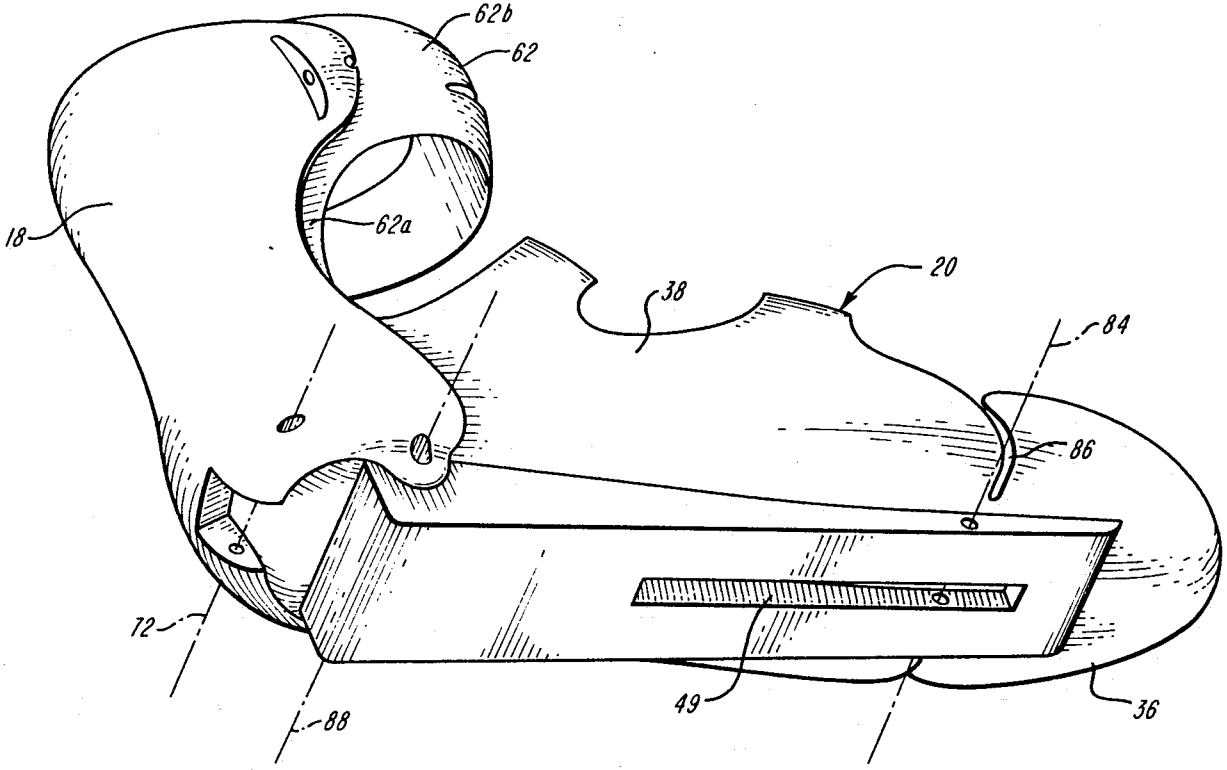
FIG. 9 is a bottom perspective view of the flexible inner shell of the present invention.

Inner shell 20 may also feature a sole 36 which is width-adjustable to more comfortably seat a wearer's foot. Referring to FIGS. 7 and 9, sole 36 includes a gap 49 which is centrally positioned in the sole and extends from the metatarsal region 36*c* through the arch region 36*b* of sole 36. A threaded screw 92 (which may also secure sole 36 to sole portion 14 of outer shell 12) extends perpendicularly through gap 49. Tightening of screw 92 will narrow the width of sole 36 while loosening of the screw will increase the width of sole 36. The illustrated sole portion 36 thus has a centrally disposed slot, formed in the illustrated embodiment by the gap 49, which extends parallel to the central axis of the wearer's foot in the boot. The screw 92 extends through the slot transverse to the slot length and provides a means, accessible externally from at least the inner shell, for selectively increasing and alternatively decreasing the width of the sole portion. Although it is Preferred to utilize a single gap to effect width adjustment of the boot, it is understood that one or more additional gaps, as well as additional threaded screws may be effectively used.

What is claimed is:

1. In a ski boot having an outer shell with an outer sole and an upper portion, a heel spoiler hingedly connected to the outer shell for pivotal movement of the spoiler between open and closed positions, and means for engaging and supporting a wearer's lower leg, the improvement comprising A. inner shell means seated within the outer shell for selectively supporting a wearer's foot and having a sole portion with at least heel, arch and metatarsal regions and having foot restraint means for supportingly engaging at least the instep region of a wearer's foot, said inner shell means being rotationally movable within the outer shell about an axis under the sole portion thereof and forward of the arch region thereof, B. means providing rotational engagement between the heel spoiler and said inner shell means forward of the hinge connection of the heel spoiler to the outer shell for imparting rotational movement to said inner shell means relative to said outer shell upon movement of said heel spoiler between said open and closed positions, and C. tension means engaged with said foot restraint means of said inner shell means and arranged for being tensioned upon closure of the heel spoiler for closing said foot restraint means for providing support to a wearer's foot and for being slackened, to release the support to a wearer's foot, upon opening the heel spoiler.

2. The ski boot according to claim 1, the further improvement wherein said foot restraint means includes a saddle portion which extends over the instep region of a wearer's foot and is movable, to selectively vary the volume within the inner shell, in response to the tension of said tension means.

3. In a ski boot according to claim 2, the further improvement wherein said tension means comprises at least one tensile element engaged with said saddle portion and extending rearward therefrom to said heel spoiler.

4. In a ski boot according to claim 1, the further improvement comprising selectively operable boot closure means for securing the boot to a wearer's foot, said closure means being connected with said tension means for tensioning said tension means upon closure of the heel spoiler.

5. In a ski boot having an outlet shell with an outer sole and an upper portion, a heel spoiler hingedly connected to the outer shell for pivotal movement of the spoiler between open and closed positions, and means for engaging and supporting a wearer's lower leg, the improvement comprising A. inner shell means seated within the outer shell for selectively supporting a wearer's foot and having a sole portion with heel, arch and metatarsal regions and having a saddle portion which extends over the instep region of a wearer's foot and is movable, to selectively vary the volume within the inner shell, said inner shell means being removably replaceable within the outer shell and being rotationally movable within the outer shell about an axis under the sole portion thereof and forward of the arch region thereof, and B. at least one tensile element engaged with said saddle portion of said inner shell means and arranged for being tensioned upon closure of the heel spoiler for closing said saddle portion for providing increased support to a wearer's foot and for being slackened, to release the support to a wearer's foot, upon opening the heel spoiler.

* * * * *